United States Patent [19]

Mascia et al.

[11] 4,136,802

[45] Jan. 30, 1979

[54] SPRAY DISPENSER WITH SPRING BIASED FLEXIBLE CONTAINER

[75] Inventors: Carmen T. Mascia, Clarendon Hills; Gary K. Hasegawa, Chicago, both of Ill.

[73] Assignee: The Continental Group, Inc., New York, N.Y.

[21] Appl. No.: 835,350

[22] Filed: Sep. 21, 1977

[51] Int. Cl.[2] ..... B65D 35/28; B05B 11/02

[52] U.S. Cl. ..... 222/95; 92/40; 220/85 B; 222/340; 222/386.5; 267/34; 267/166; 312/71

[58] Field of Search ..... 221/279; 92/40, 130 B; 267/26, 27, 34, 166; 312/71; 222/95, 96, 340, 386, 386.5, 392, 387, 92; 220/85 B

[56] References Cited

U.S. PATENT DOCUMENTS

| | | | |
|---|---|---|---|
| 2,298,884 | 10/1942 | Hope | 221/279 |
| 2,534,169 | 12/1950 | Hope | 312/71 X |
| 3,871,554 | 3/1975 | Huck | 222/96 |
| 3,951,310 | 4/1976 | Steiman | 222/340 X |
| 4,077,544 | 3/1978 | Malacheski et al. | 222/386.5 X |

*Primary Examiner*—David A. Scherbel
*Attorney, Agent, or Firm*—Charles E. Brown

[57] ABSTRACT

A dispensing unit which may be readily incorporated in an enclosure, such as a conventional can. The dispensing unit includes a readily collapsible bag in which a product to be dispensed is stored, and a plurality of spring strips. Each of the spring strips is of a construction to inherently roll into a coiled form and constantly urging the collapsing of the container. When the container is incorporated in an enclosure of the general can type including an upper end unit secured to a body by a seam, upper end portions of the spring strips may be anchored within the seam.

10 Claims, 4 Drawing Figures

FIG.1
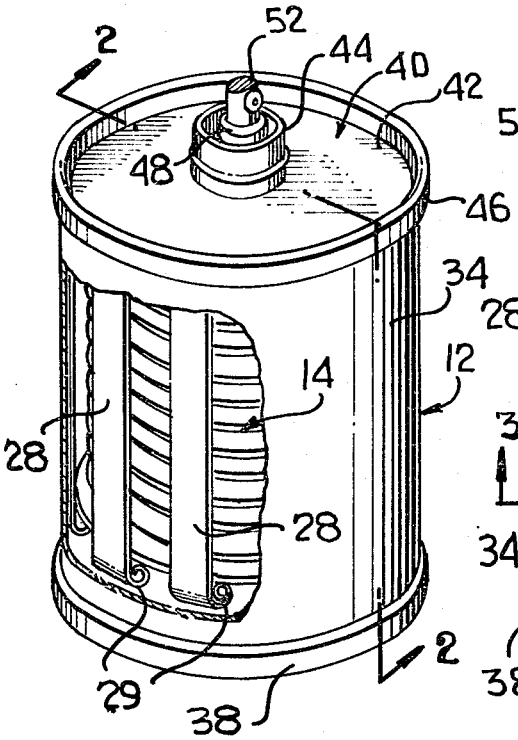
FIG.2
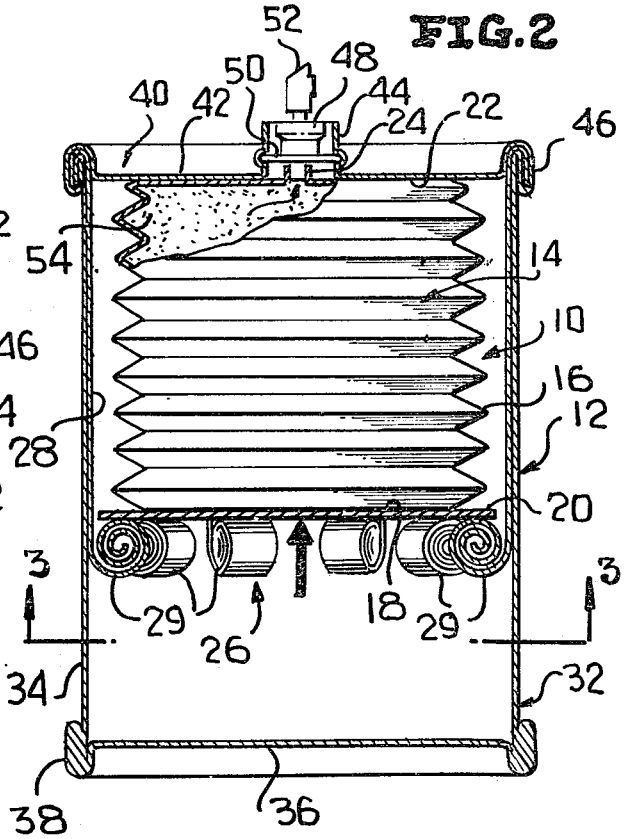
FIG.3
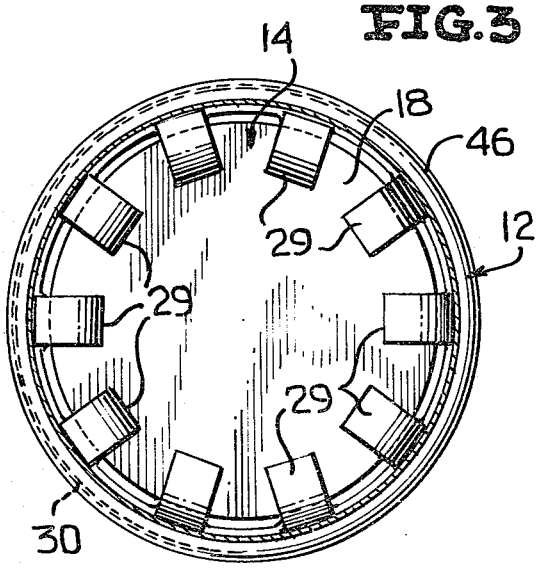
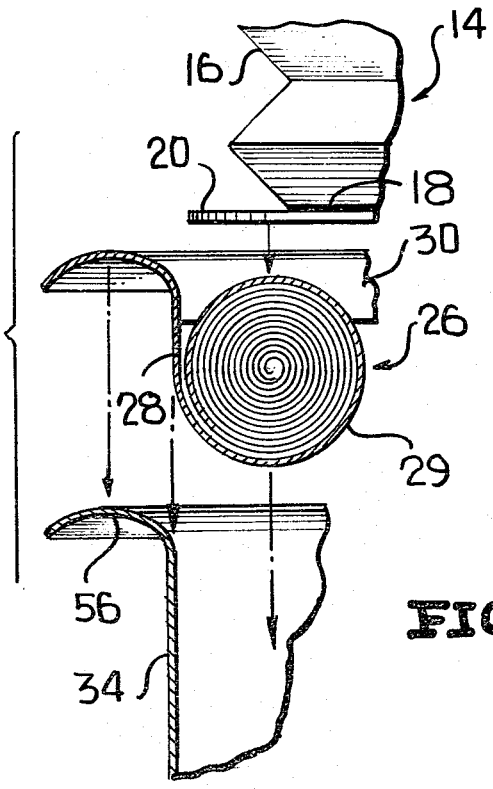
FIG.4

SPRAY DISPENSER WITH SPRING BIASED FLEXIBLE CONTAINER

This invention relates in general to new and useful improvements in containers of the dispensing type, and more particularly to a container which utilizes spring means for effecting the collapsing of a collapsible container and the dispensing of a product therein under pressure.

At the present a large number of products are being dispensed by way of aerosol cans. However, the propellant utilized in such cans have proven to be detrimental to the ecology and therefore use of such propellants must be discontinued.

In the past it has been proposed to place the product in a collapsible bag and to seat the bag on a compression spring. A specific disclosure of such an arrangement is found in U.S. patent to Block, U.S. Pat. No. 3,871,554. However, the force applied by such a spring varies as the spring expands, thereby varying the pressure on the product being dispensed.

In accordance with this invention, it is proposed to utilize a plurality of roller type springs, that is spring strips which automatically assume rolled conditions. Such spring strips may have their upper ends incorporated in the usual double seam as securing an end unit to a can body and an end unit carrying the collapsible container may be readily installed with the bottom wall of the container overlying the rolled ends of the spring strips.

If desired, the spring strips may be provided in tubular form with all of the spring strips extending from a single support and the support having a flange or curl portion which may be readily incorporated in the usual double seam.

With the above, and other objects in view that will hereinafter appear, the nature of the invention will be more clearly understood by reference to the following detailed description, the appended claims and the several views illustrated in the accompanying drawing.

IN THE DRAWINGS

FIG. 1 is a top perspective view of a dispensing unit formed in accordance with this invention, a portion of the enclosing receptacle being broken away to illustrate the internal details of the dispensing unit.

FIG. 2 is a vertical sectional view taken along the line 2—2 of FIG. 1 and shows further the specific details of the dispensing unit.

FIG. 3 is a transverse sectional view taken along the line 3—3 of FIG. 2 and shows the arrangement of the spring strips with respect to the bottom of the collapsible container.

FIG. 4 is an exploded sectional view showing the manner in which the spring strips may be assembled with a can body and the collapsible container placed therein.

Referring now to the drawings in detail, it will be seen that there is illustrated a dispensing unit which is incorporated in an enclosing receptacle. The dispensing unit is generally identified by the numeral 10 and the enclosing receptacle is generally identified by the numeral 12.

The dispensing unit 10 includes a collapsible bag, generally identified by the numeral 14, having a generally folded or corrugated body 16. The basic bag 14 is of the type specifically illustrated and disclosed in U.S. Pat. No. 3,520,337 to Irland et al.

The bag 14, in addition to the body, includes a bottom wall 18 which may be of a reinforced thickness and, if necessary, may extend circumferentially outwardly so as to have a projecting portion 20, as will be discussed hereinafter. The bag 14 also includes a top wall 22 and a neck portion 24.

The dispensing unit 10 also includes a spring unit, generally identified by the numeral 26. The spring unit 26 is in the form of a plurality of spring strips 28 which are constructed so as to inherently assume a rolled condition with the lower portions of the spring strips 28 being in the form of rolls or coils 29. Although spring strips 28 may be individually formed, it is feasible to form the spring strips 28 as parts of a singular tubular member with upper ends of the spring strips being integrally connected to a support 30 which is in the form of a flange or curl as will be described hereinafter.

The enclosing receptacle 12 may be in the form of a conventional can, generally identified by the numeral 32. The can 32 will include a body 34 having a bottom wall 36 which may be either integrally formed or in the form of a separately formed end unit secured to the body 34 by a conventional double seam 38.

The can 32 also includes an end unit 40. The end unit 40 includes an end panel 42 having a neck portion 44 projecting therefrom. The end unit 40 is secured to the body 34 by means of a conventional type of double seam 46.

It will be seen from FIG. 2 that the neck 24 of the collapsible container 14 is connected to a conventional valve unit 48. The valve unit 48 may be of the type having a mounting flange 50 which is fixedly mounted within the neck 44. A dispensing nozzle 52 is mounted on the upper end of the valve unit 48 for dispensing a product 54 stored within the bag 14 under the pressure of the spring strips 28.

Referring now to FIG. 4 in particular, it will be seen that the body 34 is provided at its upper end with a curl 56 for forming the double seam 46. It will be seen that the curl of flange 30 is configurated to interlockingly fit over the curl 56 and thus may be tightly incorporated in the double seam 46. It will also be seen that by incorporating the collapsible bag 14 with the end unit 40, the end unit 40 may be applied with the bottom wall 18 of the collapsible bag 14 engaging the rolls 29 of the spring strips 28. At this time the collapsible bag 14 could be advantageously pre-filled and thus would effect the unrolling of the rolls 29, or the valve unit 48 could be of a construction wherein the bag 14 could be filled therethrough. The manner of assembling the unit and filling the bag 14 does not form a part of this invention and will not be discussed in more detail here.

With respect to the construction of the bottom 18 of the bag, it is to be understood that when the corrugations of the body 16 are relatively small, there need be no extension 20. It is to be understood that the relative proportions of the bag 14, the can 32 and the rolls 29 of the spring strips 28 are exagerated in FIGS. 2 and 4. This is also true of the spacing between the bag 14 and the spring strips 28. It will be seen that depending upon these relative factors of spacing and dimensions, the bottom wall 18 could directly engage the rolls 29 sufficiently to eliminate the extension 20.

It will be readily apparent from a consideration of FIG. 2 that the rolls 29, when substantially fully opened, will occupy relatively small space at the bottom portion of the can 32, as is generally illustrated in FIG. 1. The rolls 29 will exert an upwardly directed force on the bottom wall 18, urging collapsing of the bag 14, thereby placing the product 54 within the bag under pressure. Thus the product 54 will be readily available for dispensing anytime the nozzle 52 is moved so as to open the valve unit 48.

It is to be understood that since the action of the spring strips 28 is a rolling one, the tension of the spring strips 28 will remain constant as the lower end portions of the spring strips roll from a partial coil to a multi-coil condition and, therefore, the pressure on the product 54 will be substantially the same in the filled condition of the bag 14 and the substantially empty condition thereof. Thus a uniform dispensing of the product 54 can be obtained.

Although only a preferred embodiment of the dispensing unit has been specifically illustrated and described herein, it is to be understood that minor variations may be made in the dispensing unit without departing from the spirit and the scope of the invention, as defined by the appended claims.

What is claimed as new is:

1. A dispensing unit for a container, said dispensing unit comprising a readily collapsible container having a bottom wall, and a spring mechanism engageable with said bottom wall, said spring mechanism including a plurality of spring strips each inherently urged towards a rolled condition, said spring strips being spaced about the exterior of said container and extend along the axial length of said container terminating in lower end portions underlying said bottom wall.

2. The dispensing unit of claim 1 wherein said container includes a body of a generally reversely folded axial section.

3. The dispensing unit of claim 1 wherein each spring strip defines a constant tension spring.

4. The dispensing unit of claim 1 wherein said spring strips are carried by a common support.

5. The dispensing unit of claim 1 wherein said spring strips are carried by a common support having means for anchorage relative to an enclosing receptacle.

6. The dispensing unit of claim 1 wherein said container includes a dispensing valve mechanism.

7. The dispensing unit of claim 1 together with an enclosing receptacle, and means anchoring said spring strips relative to said receptacle.

8. The dispensing unit of claim 7 wherein said receptacle includes an end unit secured to body by way of a seam, and said spring strips have upper ends anchored in said seam.

9. The dispensing unit of claim 8 wherein said end unit includes means for anchoring an upper part of said container.

10. The dispensing unit of claim 8 wherein said means anchoring said spring strips in said seam relative to said receptacle is in the form of an annular support member with which said spring strips are integrally formed.

* * * * *